US007784548B2

(12) United States Patent
Wilson et al.

(10) Patent No.: US 7,784,548 B2
(45) Date of Patent: Aug. 31, 2010

(54) SMART COMPRESSED CHAMBER WELL OPTIMIZATION SYSTEM

(75) Inventors: Dennis L. Wilson, Aztec, NM (US); James L. Schlabaugh, Dolores, CO (US)

(73) Assignee: ConocoPhillips Company, Houston, TX (US)

( * ) Notice: Subject to any disclaimer, the term of this patent is extended or adjusted under 35 U.S.C. 154(b) by 73 days.

(21) Appl. No.: 12/108,269

(22) Filed: Apr. 23, 2008

(65) Prior Publication Data

US 2009/0266554 A1 Oct. 29, 2009

(51) Int. Cl.
*E21B 4/18* (2006.01)

(52) U.S. Cl. ..... 166/370; 166/372

(58) Field of Classification Search ..... 166/372, 166/53, 105, 685, 105.5, 68, 370
See application file for complete search history.

(56) References Cited

U.S. PATENT DOCUMENTS

| | | | | |
|---|---|---|---|---|
| 4,509,599 | A | 4/1985 | Chenoweth et al. | |
| 5,211,242 | A | 5/1993 | Coleman et al. | |
| 5,636,693 | A | 6/1997 | Elmer | |
| 5,904,209 | A | 5/1999 | Kenworthy et al. | |
| 6,354,377 | B1 | 3/2002 | Averhoff | |
| 6,454,002 | B1 | 9/2002 | Stokes et al. | |
| 6,497,290 | B1 | 12/2002 | Misselbrook et al. | |
| 6,571,548 | B1 | 6/2003 | Bronicki et al. | |
| 6,672,392 | B2 | 1/2004 | Reitz | |
| 6,966,366 | B2 | 11/2005 | Rogers, Jr. | |
| 6,997,260 | B1 | 2/2006 | Trader et al. | |
| 2006/0237195 | A1 * | 10/2006 | Wilde | 166/372 |
| 2009/0008101 | A1 * | 1/2009 | Coady | 166/370 |

OTHER PUBLICATIONS

Sales Literature Publication, Wow Energies.
Sales Literature Publication, Enex Solutions.

* cited by examiner

*Primary Examiner*—Kenneth Thompson

(57) ABSTRACT

A system for extracting a gas and a liquid from a well broadly includes tubing strings that collect well liquid and a gas lift system that removes the collected liquid. A standing valve connects the strings and permits liquid to enter the strings from the subsurface formation. The gas lift system includes a compressor that uses pressurized gas to remove the collected liquid and discharge the liquid into a separator. The system permits liquid to be collected and removed while simultaneously producing gas from the well casing. The system includes an accumulator that stores compressed gas for removing the collected liquid.

10 Claims, 5 Drawing Sheets

SMART COMPRESSED CHAMBER WELL OPTIMIZATION SYSTEM

BACKGROUND OF THE INVENTION

1. Field of the Invention

The present invention relates generally to subsurface gas production. More specifically, embodiments of the present invention concern a natural gas well unloading system that unloads liquids from the well to permit enhanced production of natural gas.

2. Discussion of Prior Art

Hydrocarbon wells often are configured for primarily producing natural gas. Wells typically include a casing that extends from the surface to the bottom of the well bore. The casing includes a perforated area positioned next to the subsurface formation. The perforated area permits fluids to flow from the formation into the casing. While natural gas is able to pass from the formation into the casing, liquids are also permitted to pass into the casing chamber. Liquids can accumulate at the bottom of the well bore so that the liquid column blocks the perforated area and restricts natural gas from passing into the casing chamber. Natural gas recovery systems that remove well liquid to improve the production rate of gas are known in the art. For instance, it is known in the art to use a beam pump with a mechanical plunger that is slidably received within a tubing for removing well liquid.

Prior art liquid unloading systems and methods are problematic and suffer from various undesirable limitations. For instance, beam pumps are often too expensive to operate, particularly for marginal gas wells and for wells that produce small amounts of liquid. Furthermore, beam pumps do not adjust to variable environmental conditions to optimize gas production. For example, hydrocarbon fields often have many wells that tap into the same field, and each well can impact the environmental conditions experienced at other wells.

SUMMARY OF THE INVENTION

The present invention provides a well unloading system that does not suffer from the problems and limitations of the prior art systems set forth above.

A first aspect of the present invention concerns a process broadly including using a compressor to produce natural gas from a well, and using the compressor to remove a liquid from the well by simultaneously pushing the liquid with a compressed gas and pulling the liquid with a suction gas. The compressed gas is discharged from an outlet of the compressor. The suction gas is received into an inlet of the compressor.

A second aspect of the present invention concerns a method of optimizing a gas flow supplied from a natural gas well by unloading liquid from the well with a gas lift system. The gas lift system includes an outer tube, an inner tube extending within a bore of the outer tube, a compressor presenting an inlet and outlet, and a fluid separator fluidly connected to the compressor inlet, wherein the liquid is drawn into at least one of the tubes. The method broadly includes fluidly communicating the inner tube and one of the compressor outlet and inlet so that the inner tube is respectively positioned either downstream of the outlet or upstream of the inlet; fluidly communicating the outer tube and the other of the compressor outlet and inlet so that the outer tube is respectively positioned in the other of the downstream or upstream positions; and pumping the liquid out the at least one of the tubes. The pumping step includes running the compressor to draw gas from one of the tubes while pumping gas into the other tube.

A third aspect of the present invention concerns a method of optimizing a gas flow supplied from a natural gas well by unloading liquid from the well with a gas lift system. The gas lift system includes an outer tube, an inner tube extending within a bore of the outer tube, a compressor presenting an inlet and outlet, and a fluid separator fluidly connected to the compressor inlet, wherein the liquid is drawn into at least one of the tubes. The method broadly includes unloading the well by performing a gas lift cycle that propels the liquid portion out of the tubes, including performing a set number of consecutive gas lift cycles that remove respective liquid portions; measuring a property of the gas production flow; and changing the set number of consecutive gas lift cycles to unload the well during a subsequent well unloading step based on any difference between the measured flow property and a predetermined optimum value of the flow property.

A fourth aspect of the present invention concerns a system for extracting a gas and a liquid from a well. The system broadly includes a tubing system, a gas-liquid separator, and a compressor. The tubing system extends downwardly into the well and defines first and second longitudinally-extending chambers. The gas-liquid separator defines a fluid inlet, a gas outlet, and a liquid outlet. The fluid inlet is coupled in fluid communication with the first chamber. The compressor defines a suction inlet and a discharge outlet. The suction inlet is coupled in fluid communication with the gas outlet of the gas-liquid separator. The discharge outlet is coupled in fluid communication with the second chamber.

A fifth aspect of the present invention concerns a natural gas well unloading system operable to unload liquid from a gas-producing well and thereby allow gas to flow to the surface. The unloading system broadly includes tubing, a compressor, and a fluid separator. The tubing has a fluid collection end operable to be positioned in the well, with the tubing presenting at least two chambers. The tubing is operable to extend into the well and transmit the gas and liquid from the fluid collection end to the surface. The chambers are in fluid communication with one another adjacent the fluid collection end. At least one of the chambers is configured to collect liquid from the well. The compressor presents an inlet and discharge. The compressor discharge is in fluid communication with one of the chambers. The fluid separator is configured to separate the liquid from the gas and is in fluid communication with the other of the chambers. The fluid separator is in fluid communication with the compressor inlet, with the chambers, compressor, and fluid separator cooperatively forming at least part of an endless fluid conduit so that the system is operable to drive the collected liquid from the tubing into the fluid separator by forcing compressed gas behind the collected liquid and drawing vacuum in front of the collected liquid.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1*a* is a schematic view of a natural gas well unloading system constructed in accordance with a first preferred embodiment of the present invention, showing a downhole assembly and a surface assembly, and showing the system in a gas-producing configuration wherein the system is also collecting well liquid;

FIG. 1*b* is a fragmentary schematic view of the natural gas well unloading system as shown in FIG. 1*a*, showing a logic controller of the surface assembly;

FIG. 2*a* is a schematic view of the natural gas well unloading system as shown in FIG. 1*a*, showing the system in a liquid removal configuration wherein collected liquid is removed by forcing the liquid up through an inner tube of the system;

FIG. 2*b* is a schematic view of the natural gas well unloading system as shown in FIGS. 1*a* and 2*a*, showing the system in an alternative liquid removal configuration wherein collected liquid is removed by forcing the liquid up through an annulus formed between the inner tube and an outer tube of the system;

Figures 1A, 1B:
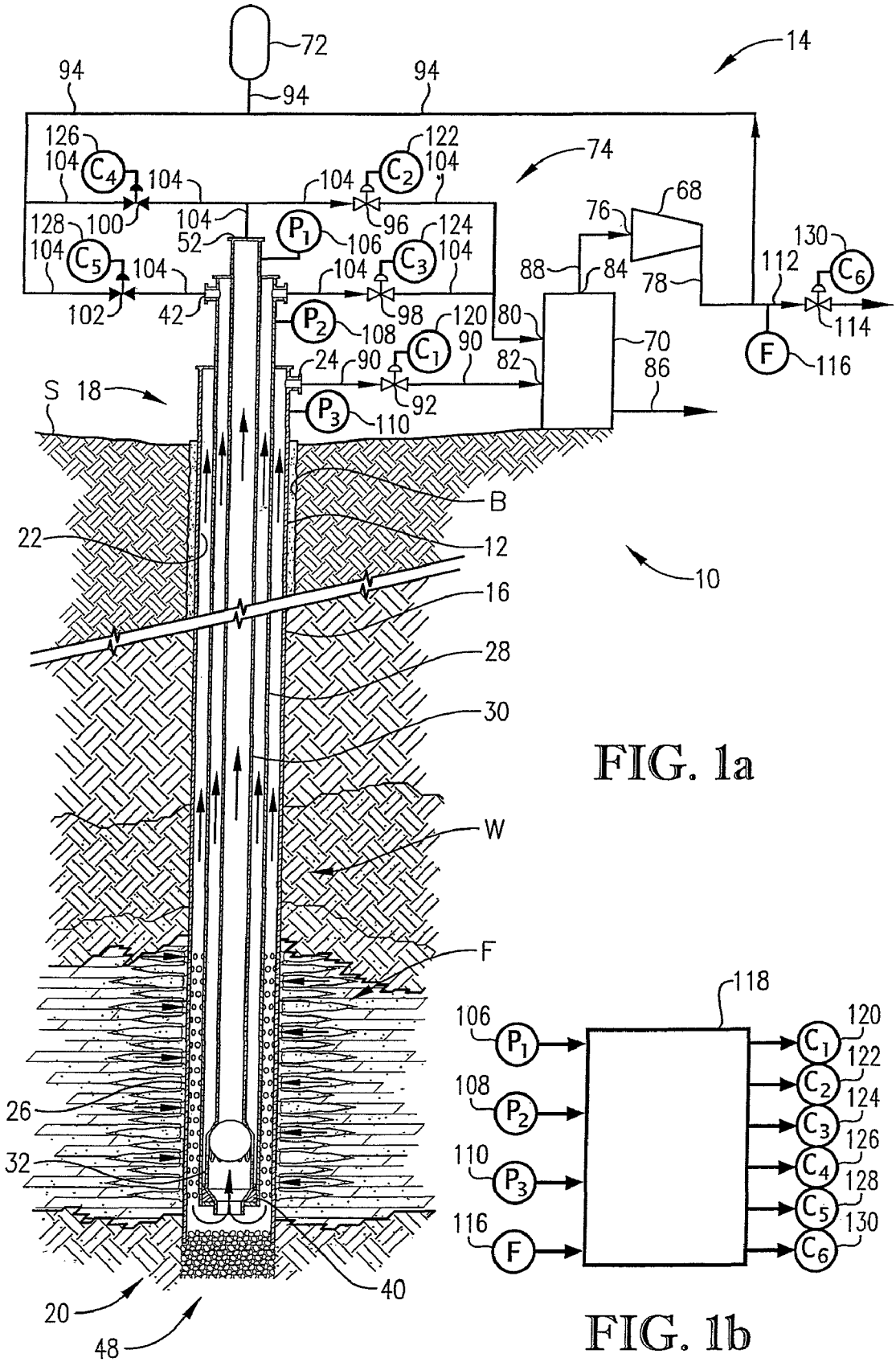

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIGS. 1*a* and 1*b*, a natural gas well unloading system 10 is operable to produce natural gas while removing production-inhibiting liquid. The system 10 is installed in a gas-producing well W that produces gas from formation F through a well bore B. While the illustrated well bore B is preferably vertical, aspects of the system 10 could be used in a well bore that is deviated from vertical without departing from the scope of the present invention. Also, the system 10 is preferably used where the well W produces less than about ten (10) barrels per day of water, more preferably where the well W produces in the range of about one (1) to about two (2) barrels per day of water. Furthermore, while the illustrated system 10 is preferably used in a well that can produce natural gas in the range of about 30 to about 80 Mcf per day, it is also within the scope of the present invention to use the system 10 with a well that produces fewer than 30 Mcf per day or greater than 80 Mcf per day. The system 10 broadly includes a downhole assembly 12 and a surface assembly 14.

The downhole assembly 12 is received within the well bore B and, among other uses, serves as a conduit for transporting natural gas and well bore liquids, such as water, to the surface assembly 14 on the surface S. The downhole assembly 12 includes a casing 16 that extends into the well W from a surface end 18 to a lower end 20 adjacent the bottom of the well bore B. The casing 16 presents a casing chamber 22 and includes a supply fitting 24 adjacent the surface end 18 and a perforated section 26 that is positioned along the formation F. In the usual manner, the perforated section 26 includes holes that permit fluids within the formation F to pass into the casing chamber 22. Thus, natural gas is able to pass from the formation F, into the casing chamber 22, and through the supply fitting 24. Furthermore, liquids are also able to pass into the casing chamber 22 and accumulate at the lower end 20 of the casing chamber 22.

Figure 2A:
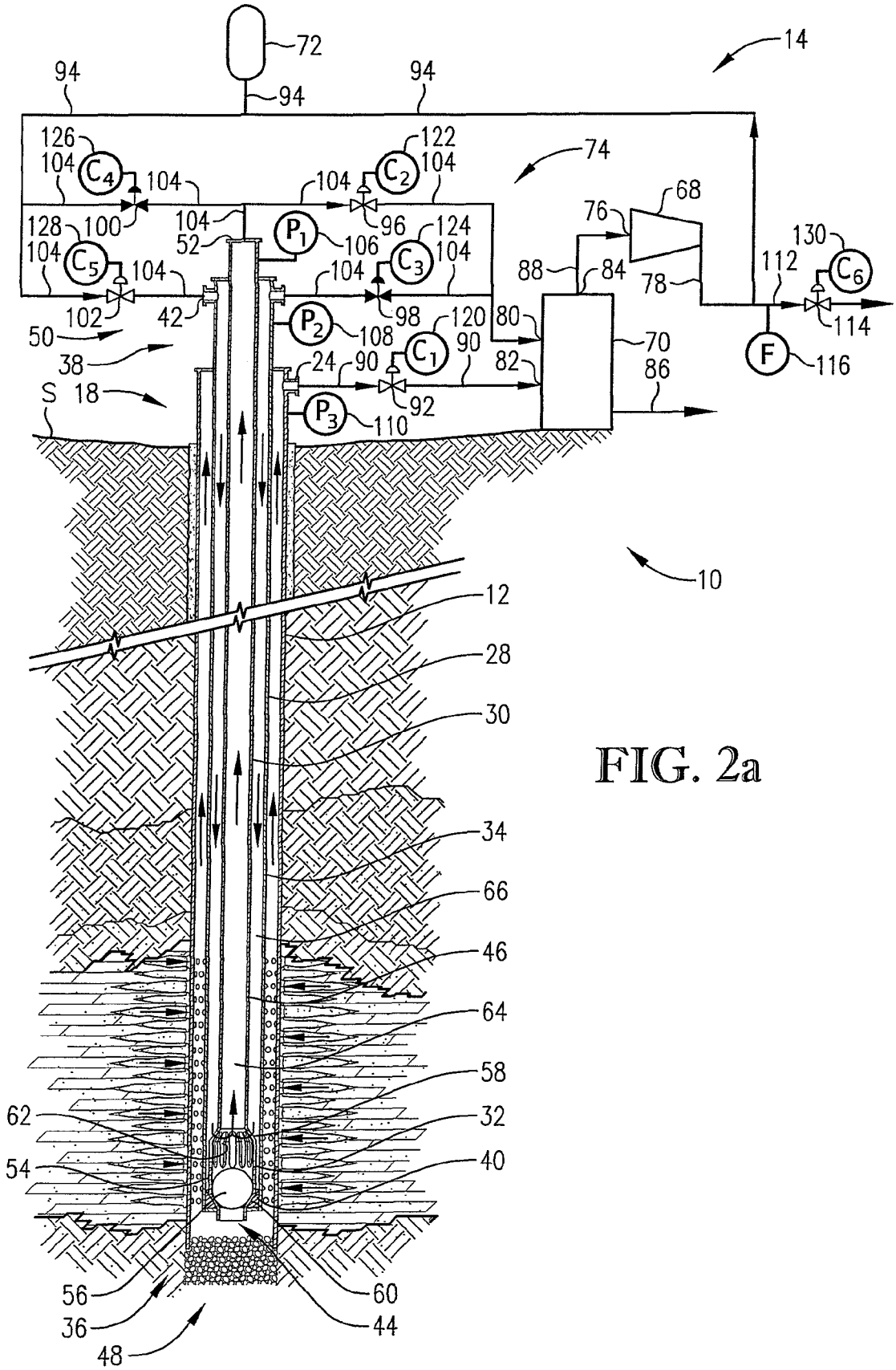
Figure 2B:
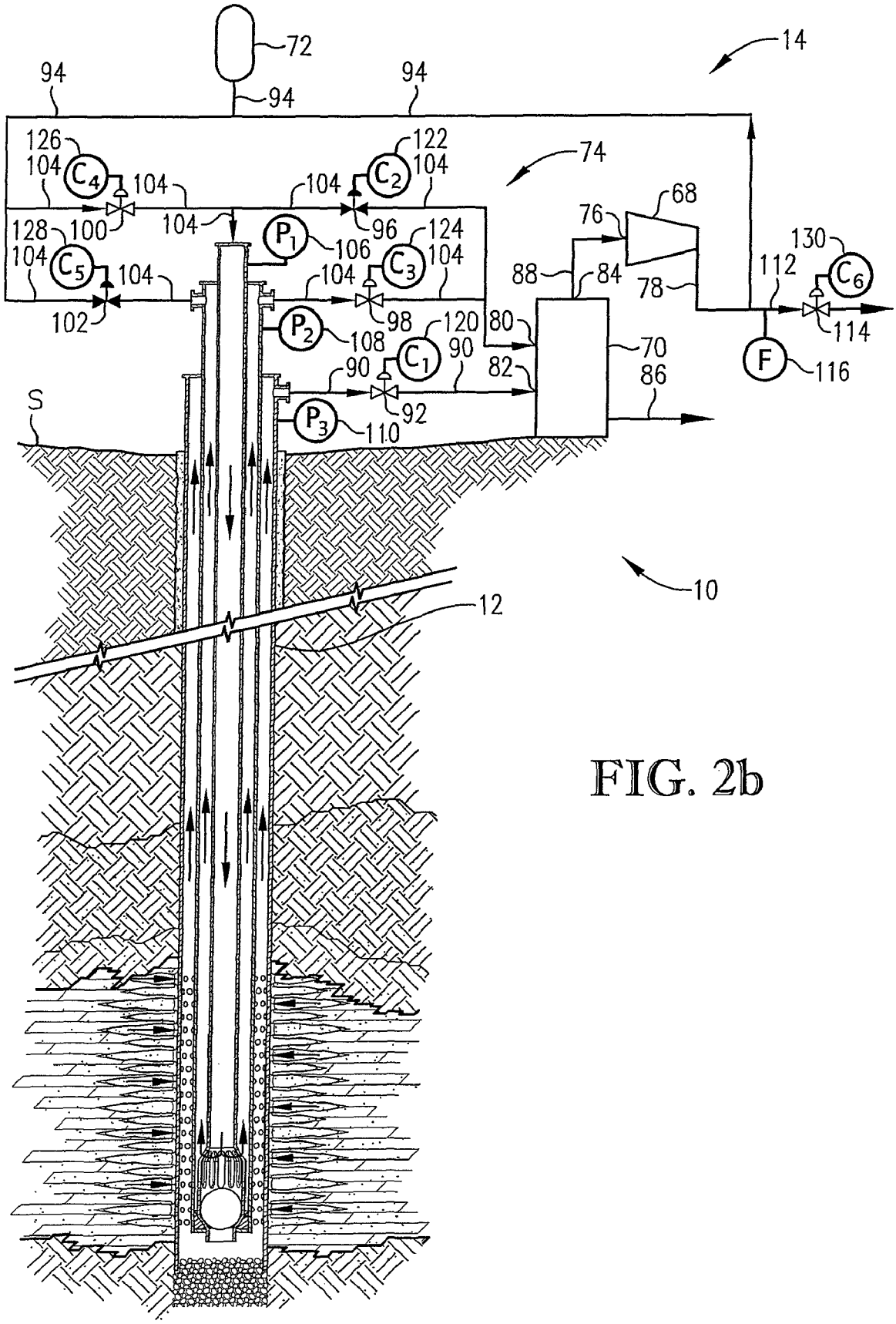
Figure 3:
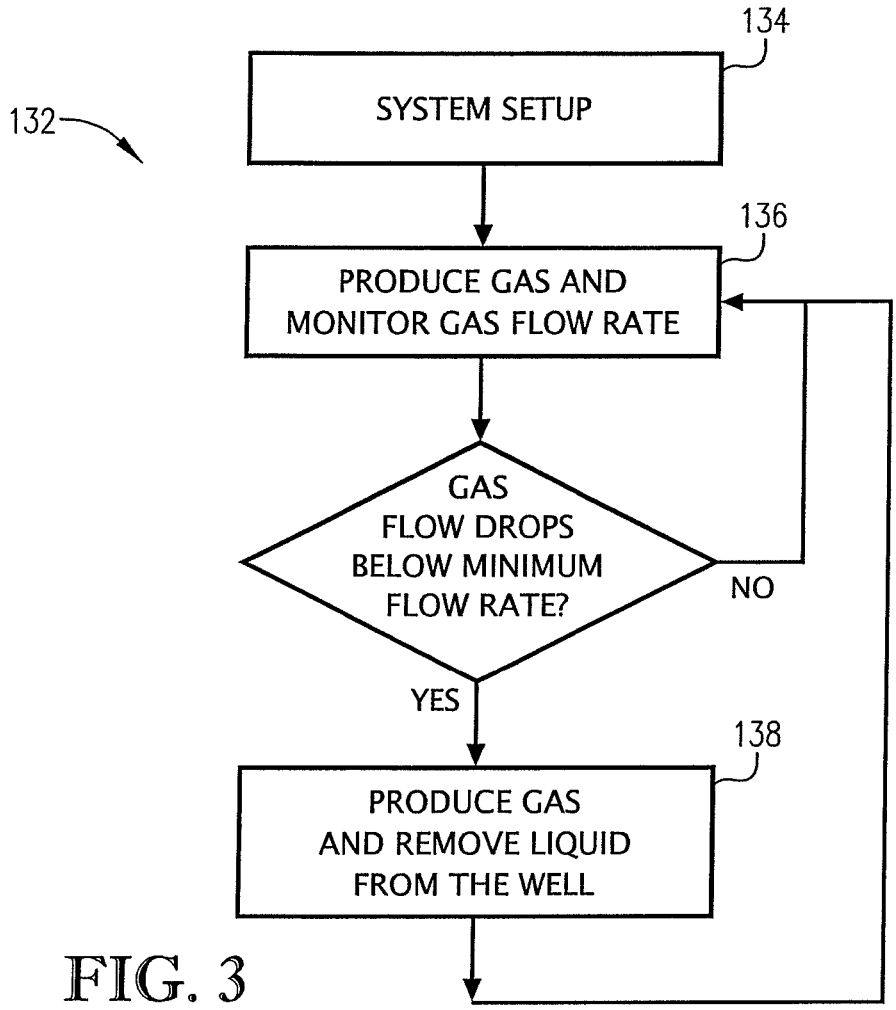
FIG. 3 is a flow diagram showing the steps for operating a natural gas well unloading system.

Turning to FIGS. 1-3, the downhole assembly 12 also includes an outer tubing string 28, an inner tubing string 30, and a vented standing valve 32 that are all received within the casing 16. The outer tubing string 28 includes an outer tube 34 that presents a lower end 36 and an upper end 38. Outer tube 34 is preferably 2⅜ inch tubing, but could be a different size without departing from the scope of the present invention. The outer tubing string 28 also includes a seating nipple 40 fixed to the outer tube 34 adjacent the lower end 36 and a supply fitting 42 adjacent the upper end 38. The seating nipple 40 presents an opening 44. The outer tubing string 28 extends into the casing chamber 22, with the lower end 36 being positioned adjacent the lower end 20 of the casing chamber 22 and the upper end 38 extending above surface S.

The inner tubing string 30 includes an inner tube 46 that presents a lower end 48 and an upper end 50. The inner tube 46 is preferably 1½ inch coiled tubing. But the principles of the present invention are applicable where the inner tube 46 is a different size or is a different type of tubing. The inner tubing string 30 also includes a supply fitting 52 adjacent the upper end 50. The inner tube 46 preferably extends into the outer tube 34 and, more preferably, is substantially concentrically arranged relative to the outer tube 34. However, the principles of the present invention are also applicable where the inner tube 46 is spaced outside of the outer tube 34.

The vented standing valve 32 includes a tubular housing 54 and a ball 56 shiftably received within the housing 54. The housing 54 presents upper and lower conical sections 58,60 that present an innermost diameter smaller than a diameter of the ball 56. The housing 54 also presents elongated vent openings 62 that are spaced about the housing circumference. The ball 56 is shiftable within the housing 54 between an uppermost position wherein the ball 56 engages the upper conical section 58 and a lowermost sealed position wherein the ball 56 engages the lower conical section 60. The standing valve 32 is configured so that gravity encourages the ball 56 to remain in the lowermost sealed position and thereby prevents fluid to flow out of the inner tube 46. But as fluids enter the inner tube 46 through the standing valve 32, fluid flow urges the ball 56 out of the lowermost sealed position. In this manner, the standing valve 32 operates as a check valve to substantially only permit flow into the inner tube 46.

The vented standing valve 32 is attached to the lower end 48 of the inner tube 46 and is carried by the inner tube 46. Preferably, the standing valve 32 is welded to the inner tube 46, but those of ordinary skill in the art will appreciate that the valve 32 could be alternatively attached to the inner tube 46. The tubing strings 28,30 are attached to one another by extending the inner tube 46 within the outer tube 34 and inserting the standing valve 32 within the opening 44 so that the lower conical section 60 is in sealing engagement with the seating nipple 40. One benefit of having the standing valve 32 fixed to the inner tube 46 is that the standing valve 32 can be installed without a rig. Thus, the inner tube 46 and the standing valve 32 can be removed to permit well maintenance, e.g., removal of sand in the well bore. The tubing strings 28,30 and the standing valve 32 cooperatively form inner and outer tubing chambers 64,66, with the inner chamber 64 extending within the inner tube 46 and the outer chamber 66 including the annular space extending between the tubes 46,34. The vent openings 62 permit fluid flow between the chambers 64,66 so that well bore liquid collected within the chambers 64,66 can be removed. Furthermore, the vent openings 62 are positioned so that any solids drawn into the chambers 64,66 when liquid is collected can be swept away from the ball 56 as liquid is removed from the chambers 64,66. This restricts solids from collecting adjacent the ball 56 over a long period of time and eventually causing failure of the standing valve 32.

Turning to FIGS. 1-3, the surface assembly 14 is configured to remove liquid and also produce natural gas from the well W. In particular, the surface assembly 14 serves as a gas-lift system that pressurizes gas to lift accumulated liquid. The surface assembly 14 broadly includes a compressor 68, a fluid separator 70, an accumulator 72, and a manifold 74 for fluidly interconnecting the downhole assembly 12, compressor 68, fluid separator 70, and the accumulator 72.

The compressor 68 is preferably a motor-driven conventional gas compressor, i.e., the compressor 68 is not configured to pump liquid. The compressor 68 includes an inlet 76 and an outlet 78, with the compressor 68 being operable to suction gas through the inlet 76, thereby drawing or pulling gas into the compressor 68, and discharge compressed gas through the outlet 78, thereby pushing gas out of the compressor 68. The compressor 68 is preferably a centrifugal compressor, but the principles of the present invention are applicable where the compressor 68 is another type of compressor such as a positive-displacement compressor. Preferably, the compressor 68 supplies gas at an outlet pressure of about 160 psi, but could provide an alternative outlet pressure.

The fluid separator 70 is a conventional gas-liquid separator and is operable to separate an incoming fluid flow into separate outgoing liquid and gas flows. The fluid separator 70 includes fluid inlets 80,82, gas outlet 84, and liquid outlet 86. The gas outlet 84 is fluidly connected to the compressor inlet 76 via a suction line 88. The fluid inlet 82 is fluidly connected to the supply fitting 52 via a production line 90 and a powered inline production valve 92. In this manner, the compressor 68 is configured to suction natural gas from the casing chamber 22 through the production line 90, through the separator 70 and through the suction line 88. But it is also within the scope of the present invention for production line 90 to bypass the fluid separator 70 and fluidly communicate directly with compressor inlet 76.

The accumulator 72 is a conventional pressure vessel that is operable to store high pressure gas for use in removing well liquid. The accumulator 72 is fluidly connected to the compressor outlet 78 via a return line 94. The return line 94 also fluidly connects the accumulator 72 to the manifold 74. While accumulator 72 preferably is positioned upstream of manifold 74, it could be alternatively positioned. For example, a line (not shown) could directly fluidly interconnect the return line 94 and one or both of the tubing strings 28,30, with the accumulator 72 being in fluid communication with that line.

The manifold 74 fluidly interconnects the tubing strings 28,30, the fluid separator 70, and the return line 94, and controls fluid flow in system 10. The manifold 74 includes inner and outer powered supply valves 96,98, inner and outer powered return valves 100,102, and manifold lines 104. The inner supply valve 96 permits fluid communication between the inner chamber 64 and the fluid inlet 80 of the separator 70. The outer supply valve 98 permits fluid communication between the outer chamber 66 and the fluid inlet 80. The inner return valve 100 permits fluid communication between the return line 94 and the inner chamber 64. The outer return valve 102 permits fluid communication between the return line 94 and the outer chamber 66. Thus, the powered valves 96,98,100,102 control fluid flow in and out of the tubing strings 28,30 at the surface S, as will be discussed further.

While the illustrated manifold 74 arrangement is preferred, the manifold 74 could have an alternative valve arrangement without departing from the scope of the present invention. For example, the manifold 74 could replace each pair of supply valves 96,98 and return valves 100,102 with a 3-way valve.

The surface assembly 14 further includes conventional pressure sensors 106,108 that fluidly communicate with the inner and outer chambers 64,66 respectively to measure static pressure therein and pressure sensor 110 that fluidly communicates with the casing chamber 22 to measure casing pressure. The surface assembly 14 also includes a gas supply line 112 that fluidly connects to the compressor outlet 78, a powered supply valve 114 that controls the flow rate of gas supplied by the system 10 through the gas supply line 112 to a sales conduit (not shown), and a flow rate sensor 116 that measures the gas supply flow rate through the gas supply line 112. Flow rate sensor 116 preferably is an electrical flow meter and preferably is an orifice flow meter, but the sensor 116 could be an alternative type of flow meter without departing from the scope of the present invention.

Yet further, the surface assembly 14 includes a terminal unit 118 that monitors operation of the system 10. In particular, the terminal unit 118 preferably comprises a controller that is operable to monitor well conditions and control the valves 92,96,98,100,102,114 in response to the conditions. More preferably, the terminal unit 118 includes a controller designated PCS 2000 and manufactured by Production Control Services, 3771 Eureka Way, Frederick, Colo. The controller could be provided by other manufacturers such as Emerson Process Management or Ferguson. Also, the terminal unit 118 could include other components for monitoring or controlling the system 10 without departing from the scope of the present invention. For example, the terminal unit 118 could include a timer, such as those manufactured by Fisher Scientific of Pittsburgh, Pa., or Chemray Corporation of Westmont, Ill. The terminal unit 118 could also include a totalizer. Preferably, the terminal unit 118 is also configured to be accessed and controlled remotely from a centralized office.

The terminal unit 118 includes inputs that receive signals from the pressure sensors 106,108,110 and the flow rate sensor 116. The terminal unit 118 also preferably includes outputs that provide signals to control operation of the valves 96,98,100,102. In particular, surface assembly 14 includes switches 120,122,124,126,128,130 that are electrically connected to respective valves 92,96,98,100,102,114 and are electrically connected to the terminal unit outputs. However, the valves 92,96,98,100,102,114 could be manually controlled or controlled by an apparatus other than the terminal unit 118 without departing from the scope of the present invention.

The valves 96,98,100,102 are operable to place the system 10 into various operating configurations. In a production configuration, valves 96,98 are open while valves 100,102 are closed (see FIG. 1). This configuration permits gas to be produced from formation F by suctioning the gas with the compressor 68 directly from the casing chamber 22 and through the fluid separator 70. Preferably at the same time, gas within the tubing strings 28,30 is also being suctioned by the compressor 68 so that well liquid in the casing chamber 22 is drawn through the standing valve 32 and collected into the chambers 64,66. However, it is also within the scope of the present invention where liquid is not collected during gas production, but is collected while gas is not being produced. Also, pressurized gas from the compressor outlet 78 fills the accumulator 72 to aid liquid removal as will be discussed further. The same compressor 68 preferably produces gas from the casing chamber 22 and draws gas from the tubing strings 28,30 to collect liquid. For some aspects of the present invention, more than one compressor could be used to perform the production and liquid collection steps, e.g., where a separate compressor is used for each step, without departing from the scope of the present invention.

In a liquid removal configuration, valves 96,102 are open while valves 98,100 are closed (see FIG. 2*a*). This configuration preferably permits gas to be produced from formation F while simultaneously removing the collected liquid. However, the principles of the present invention are applicable where liquid removal does not occur during gas production, but at a time when gas is not being produced. The liquid removal configuration preferably results in the system 10 forming an endless fluid conduit, with the conduit presenting an endless flow loop, for using pressurized gas to lift the liquid from the well W. In particular, high pressure gas stored within the accumulator 72 and supplied by the compressor 68 is permitted to flow into the outer chamber 66 on one side of the collected liquid by opening the valve 102 to thereby push the liquid. The introduction of high pressure gas causes the ball 56 to return to the lowermost sealed position to restrict fluid, particularly collected liquid, from passing out of the chambers 64,66. Because the ball 56 returns to the sealed position during liquid removal, the vented standing valve 32 also prevents the formation F from being exposed to pressure variations associated with the liquid removal process. In other words, the vented standing valve 32 prevents fluid communication between the chambers 64,66 and the casing chamber 22 so that pressure variations in the chambers 64,66 are not transmitted to the casing chamber 22. In this manner, the formation F is not directly exposed to pressure variations that could reduce productivity of the formation F.

The compressor 68 also fluidly communicates with the separator 70 and the inner chamber 64 via the valve 96 to suction gas from the inner chamber 64 to provide a low pressure, e.g, a partial vacuum, on the other side of the collected liquid and to thereby suction or pull the liquid. However, for some aspects of the illustrated invention, it is within the scope of the present invention where the compressor 68 does not push and pull the collected liquid to remove the liquid, e.g., the compressor 68 could be fluidly connected within the system 10 to only push the liquid by providing compressed gas behind the liquid. Preferably, the compressor 68 provides a pressure differential across the liquid that forces the liquid to move up the inner tube 46 and into the fluid separator 70. Thus, the compressor 68 serves to pump fluid, i.e., the gas and the liquid slug, through the endless fluid conduit, with the liquid slug being discharged into the fluid separator 70 and then through outlet 86. The illustrated removal configuration is preferable because the liquid achieves a terminal velocity faster by being discharged out of the inner chamber 64 instead of the annular outer chamber 66. As will be discussed, it is also within the ambit of the present invention for the liquid to be discharged out of the outer chamber 66.

In an alternative liquid removal configuration, valves 98,100 are open while valves 96,102 are closed (see FIG. 2*b*). This configuration also permits gas to be produced from formation F while simultaneously removing the collected liquid. Furthermore, this configuration creates an endless fluid conduit for pumping the liquid into the fluid separator 70. In particular, high pressure gas passes into the inner chamber 64 on one side of the liquid, with the outer tube 34 being suctioned to create low pressure within the outer chamber 64 on the other side of the collected liquid. The pressure differential across the liquid forces the liquid to move up the outer chamber 66 and into the fluid separator 70. While the alternative liquid removal configuration shown in FIG. 2*b* can be used instead of the liquid removal configuration shown in FIG. 2*a*, it is also within the scope of the present invention where both liquid removal configurations are used during a liquid removal process.

In operation, the system 10 is configured to collect liquid and remove the liquid while producing natural gas during a process 132. Turning to FIG. 3, the process 132 broadly includes a system setup process 134, a gas production and monitoring process 136, and a gas production and liquid removal process 138 if the gas flow drops below a minimum flow rate.

In greater detail, the system setup process 134 involves the setting of operating parameters. Initially, the system 10 is operated in the production configuration to perform a liquid collection cycle by collecting liquid within the chambers 64,66 and then shifted to one of the liquid removal configurations to perform a lift cycle by removing the collected liquid (see FIGS. 2*a* and 2*b*). While it is preferable to use one of the previously described liquid removal configurations during the process 132, it is also within the scope of the present invention to use another configuration for removing liquid. Furthermore, more than one liquid removal configuration could be used during the process 132 to remove liquid. Preferably, the operator manually monitors the amount of time during liquid removal that is needed to remove the entire slug of collected liquid, e.g., by listening to the liquid as it enters the fluid separator 70, and then enters that time into the terminal unit 118. The principles of the present invention are also applicable where the time is monitored by a sensor and electronically sent to the terminal unit 118. The operator then performs the collection and lift cycles one or more times until substantially no additional liquid is removed from the well W by a lift cycle. For example, each collection cycle could run for a time in the range of about 30 seconds to about 60 seconds and each lift cycle could run for a time in the range of about 1 minute to about 3 minutes. The number of lift cycles performed to reach the dry lift cycle is then entered into the terminal unit 118 by the operator. While these steps are preferably performed manually, the principles of the present invention are applicable where the system 10 performs them automatically. Also, the system 10 preferably uses a preset lift cycle time for each lift cycle, but the system 10 could be alternatively configured so that the time needed to remove liquid during one lift cycle is measured and used to set the lift cycle time for the next lift cycle.

Also during the system setup process 134, the terminal unit 118 is supplied with a value for a minimum gas supply flow rate. This value may be either in the form of an absolute value or a value that is offset from an optimum flow rate. For example, the minimum flow rate could be entered as 40 Mcf per day. Alternatively, if an optimum flow rate is identified as being 50 Mcf per day, and the minimum flow rate is identified as being the optimum flow rate minus 10 Mcf per day, then the minimum flow rate would be calculated by the terminal unit 118 as being 40 Mcf per day.

In the gas production and monitoring process 136, the system 10 is in the production configuration where liquid is collected within the chambers 64,66 and gas is produced through the casing chamber 22. At the same time, the terminal unit 118 is monitoring the flow rate of supplied gas with the flow rate sensor 116. If the measured flow rate falls below the minimum flow rate, the terminal unit 118 shifts the valves 96,98,100,102 so that the system 10 is in one of the liquid removal configurations. It is within the scope of the present invention where more than one liquid removal configuration is used during process 136. It is also within the scope of the present invention where the terminal unit 118 shifts the system 10 into one of the liquid removal configurations based on another measured flow rate or another measured fluid property, such as casing pressure or gas supply pressure.

In the gas production and liquid removal process 138, the system 10 is preferably shifted into one of the liquid removal configurations (see FIGS. 2*a* and 2*b*). It is also within the scope of the present invention where more than one liquid removal configuration is used during process 138. In either of these configurations, the compressor removes liquid from the well W by pushing the liquid with compressed gas and simultaneously pulling the liquid with suction gas. The terminal unit 118 preferably retains the system 10 in the liquid removal configuration for the preset lift cycle time. The terminal unit 118 then returns the system to the production configuration for a preset liquid collection cycle time. The terminal unit 118 is operable to perform multiple liquid collection cycles that are each followed by a lift cycle. In this manner, the terminal unit 118 performs the number of lift cycles that was preset for process 138 during the system setup process 134. After process 138 is finished, the system returns to process 136 and again produces gas until liquid is to be removed during process 138.

The terminal unit 118 also preferably performs steps to optimize performance of the well W and of the system 10. The terminal unit 118 preferably adjusts the process 138 to maximize the gas supply flow rate while minimizing the amount of power expended to remove liquid from the well W. However, the principles of the present invention are applicable where the process 138 is adjusted based on one or more properties other than gas supply flow rate, such as casing pressure or gas supply pressure. For example, the terminal unit 118 will initially add one additional lift cycle the first time the process 138 is performed and will monitor the gas supply flow rate during a subsequent process 136 to determine if the flow rate increased from the previous process 136. If the flow rate did not go up, then a subsequent process 138 will remove one lift cycle from the total number of lift cycles. In this manner, the system 10 preferably minimizes the amount of power required to unload the well W. If the flow rate went up, then the subsequent process 138 will add yet another lift cycle from the total number of cycles. After the system 10 performs a number of processes 138, the terminal unit 118 will identify an optimum gas supply flow rate and will adjust the number of lift cycles to maintain that flow rate.

While the illustrated process 132 preferably is configured to adjust to changing well conditions, the principles of the present invention are applicable where the system 10 uses a different process for unloading the well W that is not a function of well conditions. For instance, the process 132 could include process 136 being performed for a predetermined time, such as one hour, followed by the process 138 being performed for another predetermined time, such as twenty minutes. Also, the illustrated process preferably minimizes the amount of power to unload the well W while optimizing production. It is also within the scope of the present invention where the process 132 operates to maximize well production without trying to minimize the amount of power expended to unload the well W.

Figure 4:
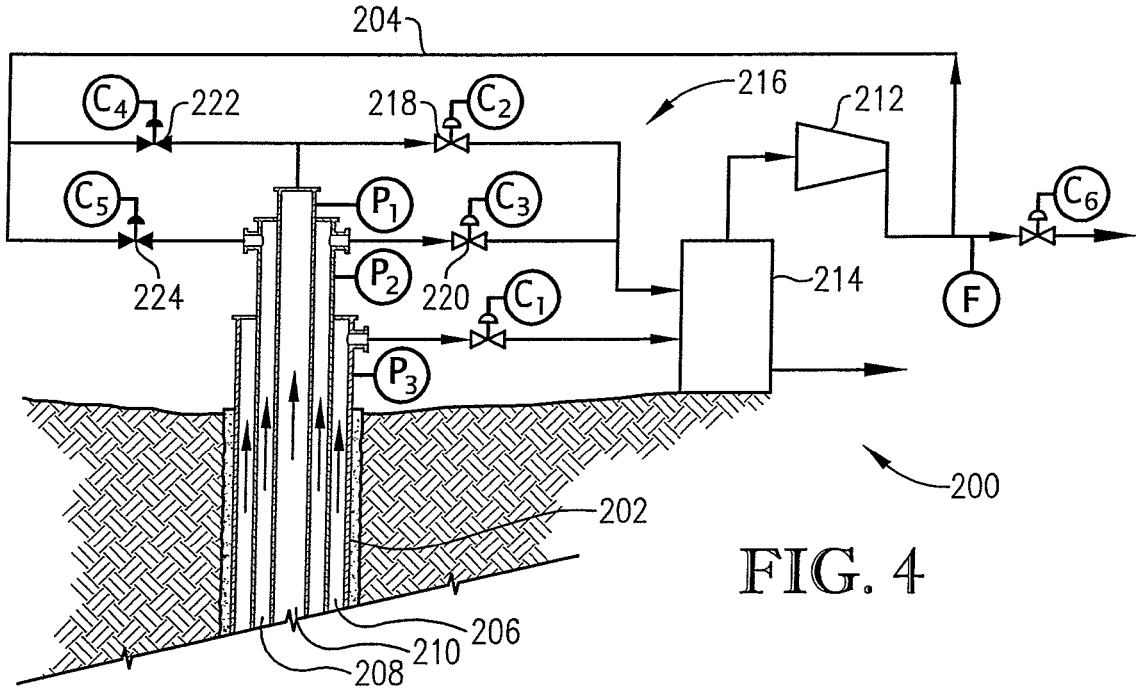
FIG. 4 is a fragmentary schematic view of a natural gas well unloading system constructed in accordance with a second preferred embodiment of the present invention, showing the system in a gas-producing configuration.
Figure 5:
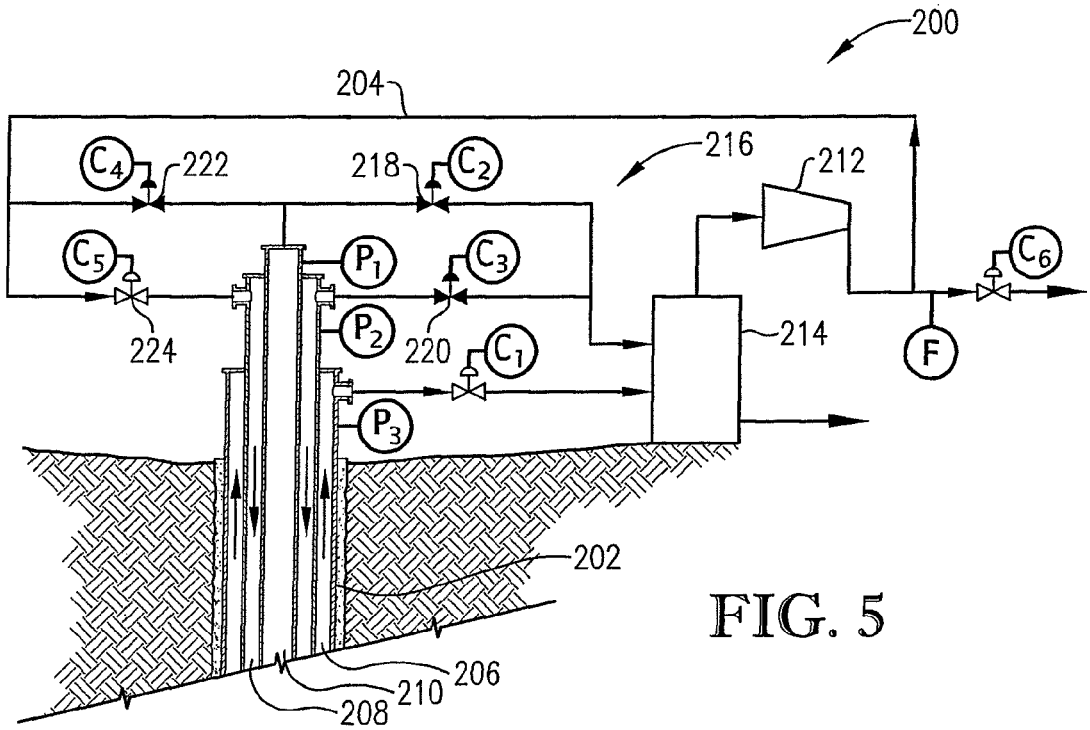
FIG. 5 is a fragmentary schematic view of the natural gas well unloading system as shown in FIG. 4, showing the system in an accumulator configuration.
Figure 6:
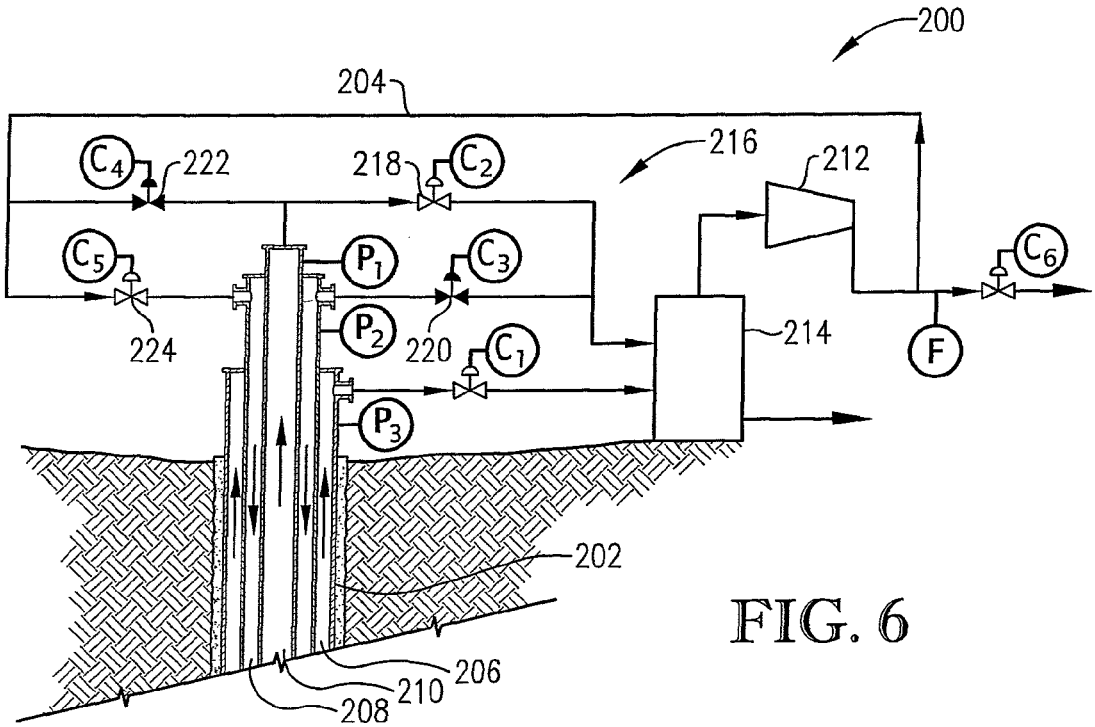
FIG. 6 is a fragmentary schematic view of the natural gas well unloading system as shown in FIGS. 4 and 5, showing the system in a liquid removal configuration.

Turning to FIGS. 4-6, alternative system 200 is constructed in accordance with a second preferred embodiment of the present invention. For the sake of brevity, the remaining description will focus primarily on the differences of this embodiment from the preferred embodiment described above.

The alternative system 200 includes a downhole assembly 202 and an alternative surface assembly 204. The downhole assembly 202 presents casing chamber 206 and tubing chambers 208,210. The surface assembly 204 includes a compressor 212, a fluid separator 214, and a manifold 216 for fluidly interconnecting the downhole assembly 202, compressor 212, and fluid separator 214. The manifold 216 includes valves 218,220,222,224. Compared to the system 10, the alternative system 200 does not include an accumulator vessel similar to accumulator 72.

In use, the alternative system 200 operates by using the tubing chambers 208,210 as an accumulator. In greater detail, the system 200 is operable in a production configuration where valves 218,220 are open and valves 222,224 are closed so that liquid is collected from the well W while the well W produces gas through the casing chamber 206 (see FIG. 4). The system 200 is then operable to be placed in an accumulator configuration where valves 218,220,222 are closed and valve 224 is opened (see FIG. 5). In the accumulator configuration, the compressor 212 builds gas pressure within the chambers 208,210 because both of the return valves 218,220 are closed and prevent return flow to the compressor 212. In this manner, the chambers 208,210 serve as an accumulator. When a sufficient gas pressure is achieved within the chambers 208,210 to push the collected liquid slug out of the downhole assembly 202, the system 200 is operable to shift into the liquid removal configuration where valves 218,224 are open and valves 220,222 are closed.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A natural gas well unloading system operable to unload liquid from a gas-producing well and thereby allow gas to flow to the surface, said unloading system comprising:

tubing having a fluid collection end operable to be positioned in the well, with the tubing presenting at least two chambers, said tubing being operable to extend into the well and transmit the gas and liquid from the fluid collection end to the surface, said chambers being in fluid communication with one another adjacent the fluid collection end, at least one of said chambers being configured to collect liquid from the well;

a compressor presenting an inlet and discharge, said compressor discharge being in fluid communication with one of the chambers; and a fluid separator configured to separate the liquid from the gas and being in fluid communication with the other of the chambers, an accumulator in fluid communication with and between the compressor discharge and the one of the chambers; and said fluid separator being in fluid communication with the compressor inlet, with the chambers, compressor, and fluid separator cooperatively forming at least part of an endless fluid conduit so that the system is operable to drive the collected liquid from the tubing into the fluid separator by forcing compressed gas behind the collected liquid and drawing vacuum in front of the collected liquid.

2. The unloading system as claimed in claim 1, said tubing comprising inner and outer tubes, with the inner tube received within the outer tube; and a check valve attached to the tubing adjacent the fluid collection end, said check valve being operable to fluidly connect the chambers with the well so that the liquid is permitted to flow from the well into at least one of the chambers and be collected.

3. The unloading system as claimed in claim 2, said inner and outer tubes being substantially concentric, said inner and outer tubes cooperatively defining the one of the chambers, with the one of the chambers being the annular space between the tubes, said inner tube defining the other of the chambers therein.

4. The unloading system as claimed in claim 2, said check valve comprising a standing valve, said tubes being interconnected at the fluid collection end by the standing valve.

5. The unloading system as claimed in claim 4, said standing valve being attached to the inner tube, said outer tube including a seating nipple, with the standing valve and seating nipple being in sealing engagement with one another, said standing valve serving as the only fluid path for collecting liquid.

6. The unloading system as claimed in claim 1; and a casing configured to be received by the well and defining a casing chamber, said tubing system being substantially received in said casing chamber.

7. The unloading system as claimed in claim 6, said compressor inlet being in fluid communication with the casing chamber so that gas is produced from the casing chamber.

8. The unloading system as claimed in claim 7, said fluid separator being in direct fluid communication with the casing chamber so that produced gas flows through the fluid separator before reaching the compressor.

9. The unloading system as claimed in claim 1, said tubing including an access end opposite the fluid collection end and operable to be positioned adjacent the surface; and a manifold assembly including a pair of return valves, with each return valve controlling fluid communication between the compressor discharge and a respective one of the chambers, said manifold assembly including a pair of supply valves, with each supply valve controlling fluid communication between the compressor inlet and a corresponding one of the chambers.

10. The unloading system as claimed in claim 9;

sensors operable to measure pressure within the well, pressure within each of the chambers, and gas flow rate supplied by the system; and a logic controller operably coupled to the sensors and the valves and configured to control the valves in response to a signal from at least one of the sensors.

* * * * *